US005488852A

United States Patent [19]

Nishikawa et al.

[11] Patent Number: 5,488,852

[45] Date of Patent: Feb. 6, 1996

[54] TRANSFER FEEDER FOR HOT-FORGING PRESSES

[75] Inventors: Junji Nishikawa; Ryoichi Yamada, both of Niihama, Japan

[73] Assignee: Sumitomo Heavy Industries, Ltd., Tokyo, Japan

[21] Appl. No.: 262,448

[22] Filed: Jun. 20, 1994

[30] Foreign Application Priority Data

Jun. 30, 1993 [JP] Japan ..... 5-189463

[51] Int. Cl.[6] ..... B21D 43/05

[52] U.S. Cl. ..... 72/405.13

[58] Field of Search ..... 72/405; 198/621, 198/621.1–621.4

[56] References Cited

U.S. PATENT DOCUMENTS

| | | | |
|---|---|---|---|
| 3,760,957 | 9/1973 | Berger | 72/405 |
| 4,811,834 | 3/1989 | Asano | 72/405 |
| 4,873,860 | 10/1989 | Werner | 72/405 |
| 5,267,463 | 12/1993 | Doyama | 72/405 |

FOREIGN PATENT DOCUMENTS

| | | | |
|---|---|---|---|
| 63-215330 | 9/1988 | Japan . | |
| 66027 | 3/1989 | Japan | 72/405 |

*Primary Examiner*—Daniel C. Crane

*Attorney, Agent, or Firm*—Nikaido Marmelstein Murray & Oram

[57] ABSTRACT

A transfer feeder for hot-forging presses having a clamping mechanism to move two parallel feed bars in the clamp and unclamp directions, an advancing mechanism to move them in the advance and return directions, and a lifting mechanism to raise and lower them. The two feed bars are connected to an inner frame via a pair of parallel links and a pair of supporting links, the inner frame is rockably supported on an intermediate frame in the advance and return directions, the intermediate frame is supported on the outer frame to be freely raised and lowered in relation to the outer frame, the clamping mechanism is so constructed as to rock parallel links in the clamp and unclamp directions, the advancing mechanism is so constructed as to rock the inner frame in relation to the intermediate frame, and the lifting mechanism is so constructed as to raise and lower the intermediate frame in relation to the outer frame. The advantages are that the clamping mechanism is perfectly synchronized and, if the central segment of a feed bar is removed, end segments will not hang down.

3 Claims, 10 Drawing Sheets

TRANSFER FEEDER FOR HOT-FORGING PRESSES

BACKGROUND OF THE INVENTION

1. Field of the Invention

This invention relates to a transfer feeder for hot-forging presses. This transfer feeder is a device for transferring a workpiece forged in a press to the next process, and transfer of the workpiece is accomplished by a pair of feed bars, i.e. front feed bar and back feed bar, repeating a series of clamping, lifting, advancing, lowering, releasing, and returning (or CLAMP, LIFT, ADVANCE, DOWN, UNCLAMP, and RETURN) as shown in FIG. 9.

2. Description of the Related Art

An example of a conventional transfer feeder is described in Japanese Patent Laid-Open No. 63-215330.

The clamping mechanism of this transfer feeder is constructed as shown in FIG. 10. 101 is a front feed bar and 102 is a back feed bar. A driving link 103 is connected to the front feed bar 101 and a driven link 104 is connected to the back feed bar 102. A motor-driven bolt-nut screw mechanism 105 is connected to the driving link 103, which is, in turn, connected to the driven link 104 through a transmission link 106. With this clamping mechanism, when the screw mechanism 105 is driven by the motor, the driving link 103 is directly set in motion and the driven link 104 is moved via the transmission link 106, and front and back feed bars 101 and 102 clamp the workpiece G.

FIG. 11 shows the advancing mechanism of the transfer feeder as shown in FIG. 10. Since the feed bars 101 and 102 are long, both consist of a central segment 101*a* and end segments 101*b* connected to both ends thereof.

With the conventional clamping mechanism as described, because the driven link 104 rocks via the transmission link 106, its rock path subtly differs in geometry from that of the driving link 103, and the clamp timing of the front feed bar 101 and back feed bar 102 are not perfectly synchronized and a clamping failure may occur.

In addition, with the conventional advancing mechanism, when the central segment shown in FIG. 11 is removed, the end segments 101*b* at both sides hang down. To avoid this, it is necessary to install cylinders 107 inside the upright in order to support the end segments. This involves a complex structure inside the upright.

Moreover, with the conventional transfer feeder, both the heavy clamping mechanism and advancing mechanism are completely raised and lowered. This involves high power for movement and makes quick movement impossible.

SUMMARY OF THE INVENTION

In consideration of this situation, it is the object of the invention to provide a transfer feeder such that the clamping mechanism is perfectly synchronized, end segments will not hang down even when the central segment is removed, and the lifting mechanism can be constructed with a low-power source.

A transfer feeder according to the invention for transferring workpieces in a three-dimensional space having a clamping mechanism for clamping and unclamping a workpiece by a pair of feed bars consisting of a front feed bar and a back feed bar, and a lifting mechanism for raising and lowering the clamped workpiece, wherein the transfer feeder comprises an inner frame to rockably support the pair of feed bars in the clamp and unclamp directions, an intermediate frame disposed outside the inner frame and rockably supporting the inner frame in the advance and return directions, and an outer frame to contain the intermediate frame to freely raise and lower the intermediate frame, the clamping mechanism comprising a pair of parallel links installed between the inner frame and the pair of feed bars, and a first rocking mechanism to rock the pair of parallel links in the clamp and unclamp directions, the advancing mechanism comprising a pair of supporting links installed between the inner frame and the pair of feed bars and a second rocking mechanism to rock the inner frame in the advance and return directions, supporting links together with parallel links of the clamping mechanism forming a parallel link moving in the advance and return directions, the lifting mechanism being comprising of an elevator mechanism to raise and lower the intermediate frame in relation to the outer frame.

The lifting mechanism preferably further comprises balance cylinders to bear the weight of the intermediate frame.

Because the clamping mechanism according to the invention rocks the front and back feed bars at the same time for clamping and unclamping a workpiece by means of a pair of parallel links and a first rocking mechanism, the pair of feed bars are perfectly synchronized and no failure in clamping can occur.

In the advancing mechanism according to the invention, supporting links installed between the inner frame and feed bars together with parallel links of the clamping mechanism form a parallel link moving in the advance and return directions. Therefore, the end segments will not hang down, even when the central segment is removed. This means that there is no need for cylinders to be installed inside the upright to prevent hanging down.

If the lifting mechanism according to the invention is equipped with balance cylinders to bear the weight of the intermediate frame, even low power will be sufficient for the elevator mechanism and quick raising and lowering are possible.

An embodiment of the invention is described referring to the drawings below.

DESCRIPTION OF THE PREFERRED EMBODIMENT

The transfer feeder consists of long feed bars and uprights arranged at their both ends, and a clamping mechanism and an advancing mechanism are built in each one of this pair of uprights. FIGS. 1 to 8 show only one of the uprights mentioned above.

Figure 1:
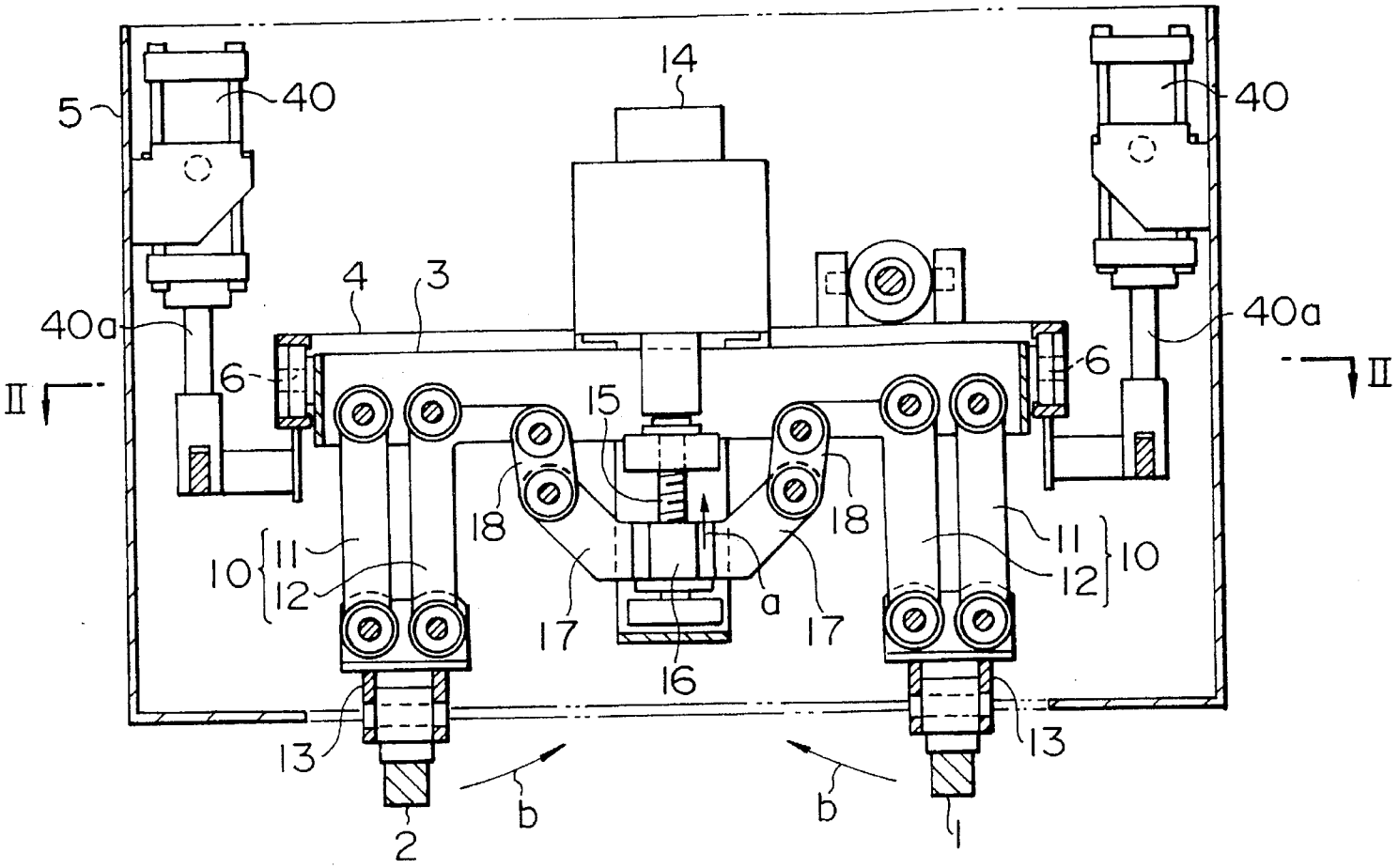
FIG. 1 is a front view of the, clamping mechanism in an embodiment of the transfer feeder according to the invention and is the cross section taken along line I—I in FIG. 2.
Figure 2:
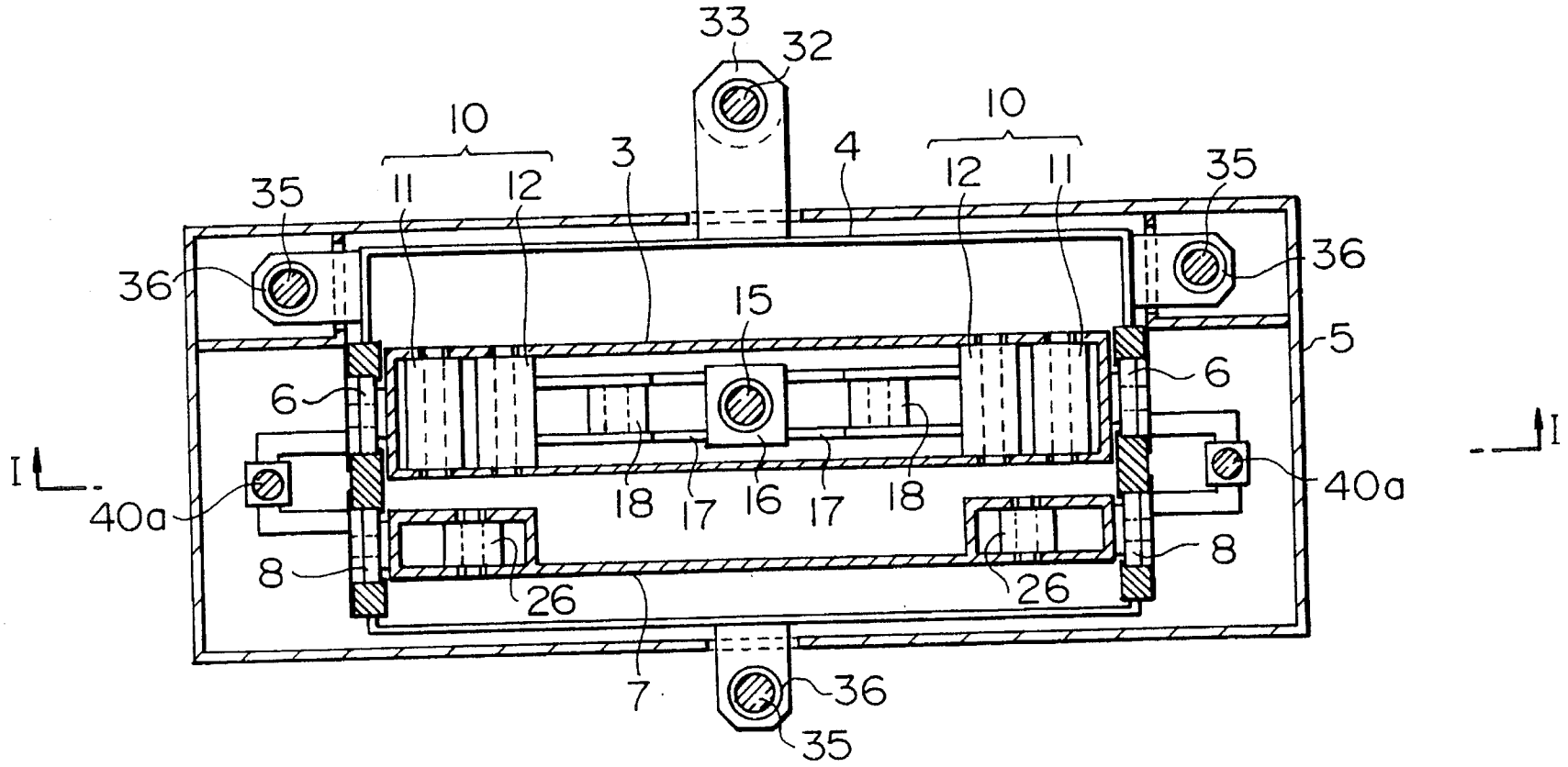
FIG. 2 is a top view of the clamping mechanism and is the cross section taken along line II—II in FIG. 1.

FIG. 1 is a front view of the clamping mechanism taken along line I—I in FIG. 2, and FIG. 2 is a top view of the clamping mechanism taken along line II—II in FIG. 1. In FIGS. 1 and 2, 1 is a front feed bar, 2 is a back feed bar, 3 is an inner frame, 4 is an intermediate frame, and 5 is an outer frame. At both ends of the inner frame 3, two parallel links 10 each consisting of a pair of links 11 and 12 are held on the respective pairs of shafts. The front feed bar 1 and back feed bar 2 are connected to the lower end of each parallel link at their respective ends via couplings 13 which allow rotation in the advance and return directions.

The first rocking mechanism is constructed as follows: A servo motor 14 is installed at the center of the inner frame 3 and a bolt 15 is connected to the spindle of the motor. A nut 16 is engaged on this bolt 15 to form a well-known bolt-nut screw mechanism. From the nut 16, arms 17 extend to both sides, and the end of each arm 17 is connected through a connecting link 18 to an inner L-shaped link 12 of the parallel link 10.

With the first rocking mechanism, when the bolt 15 is rotated by the servo motor 14 to move the nut 16 upward (in the direction of the arrow a), this movement is transmitted via links 18 to parallel links 10 and they rock inward. As a result, the front feed bar 1 and back feed bar 2 move in the direction of the arrow b close to each other, clamping a workpiece. When the servo motor 14 is rotated in reverse, a release motion is accomplished as a matter of course. For the motions described above, because the linear motion of one bolt-nut screw mechanism is converted to a rock motion by one pair of parallel links 10, the front and back feed bars 1 and 2 are perfectly synchronized and a failure in clamping is not likely to occur at all.

The advancing mechanism is described below. As shown in FIG. 2, the inner frame 3 is held at both ends on bearings 6 rockably in relation to the intermediate frame 4 in the advance and return directions. Also, in front of the inner frame 3 in the intermediate frame 4, the second inner frame 7 is held at both ends on bearings 8 rockably in relation to the intermediate frame 4 in the advance and return directions.

Figure 3:
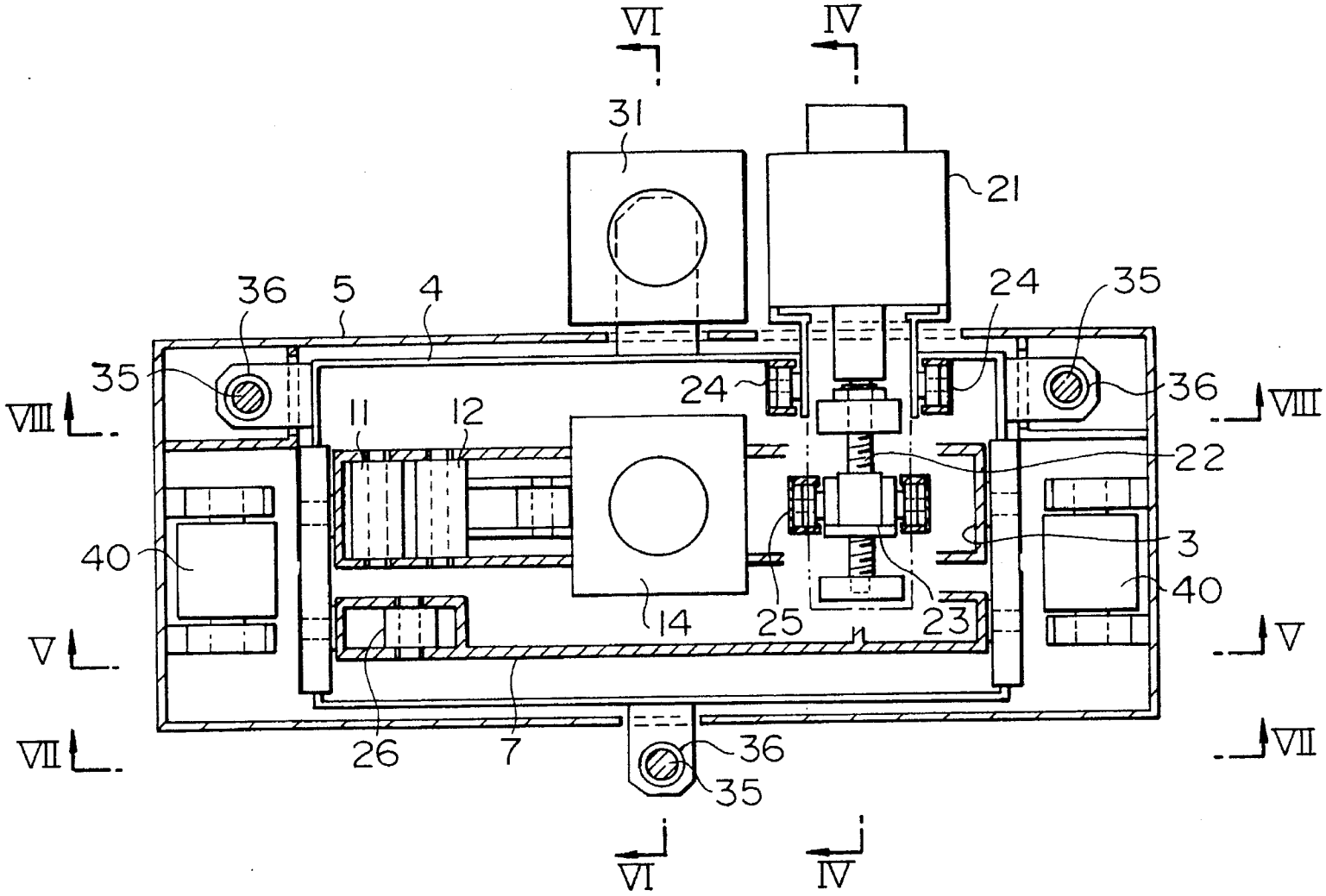
FIG. 3 is a top view of the transfer feeder in FIG. 1.
Figure 4:
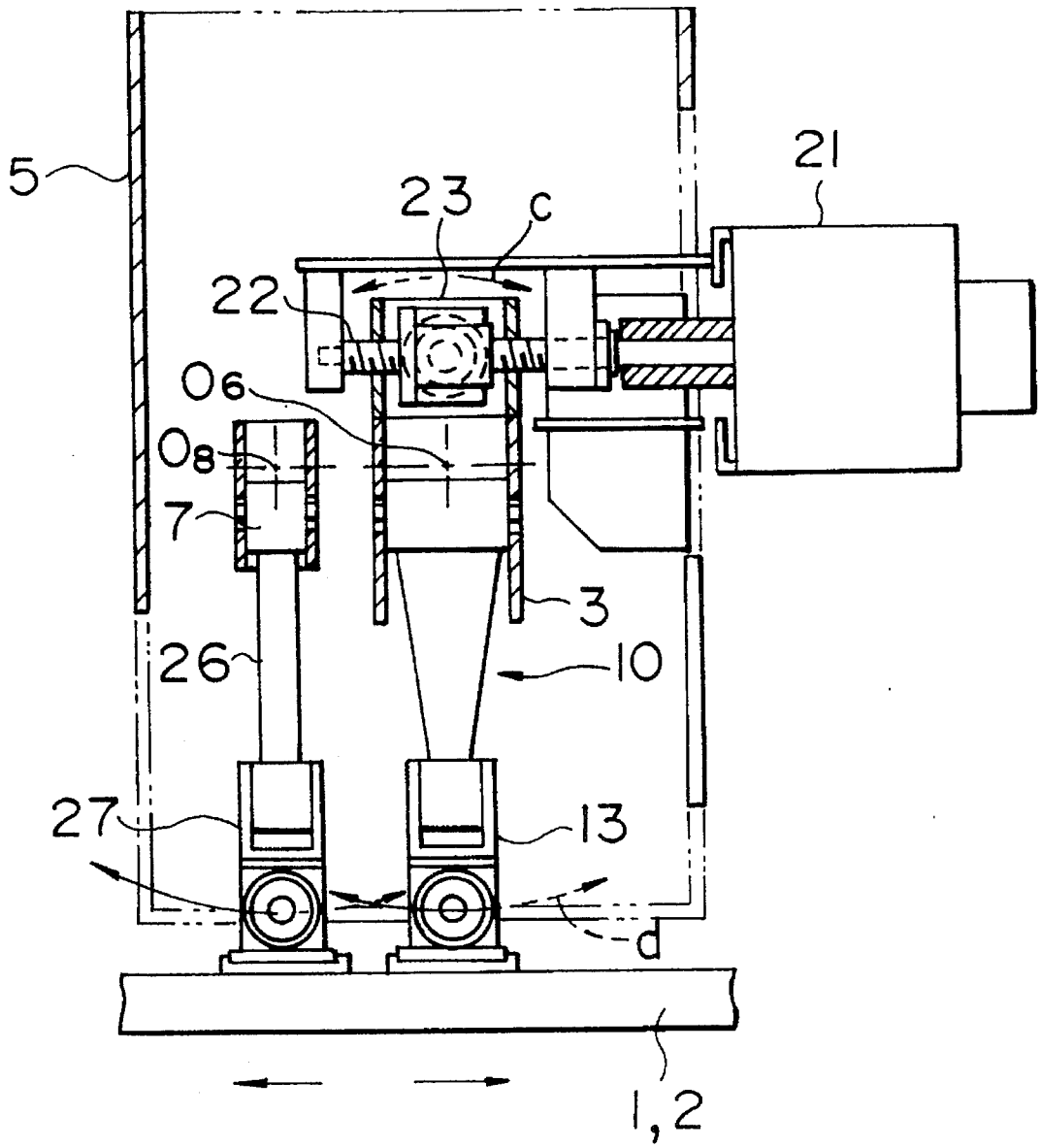
FIG. 4 is a cross section showing an advancing mechanism taken along line IV—IV in FIG. 3.
Figure 5:
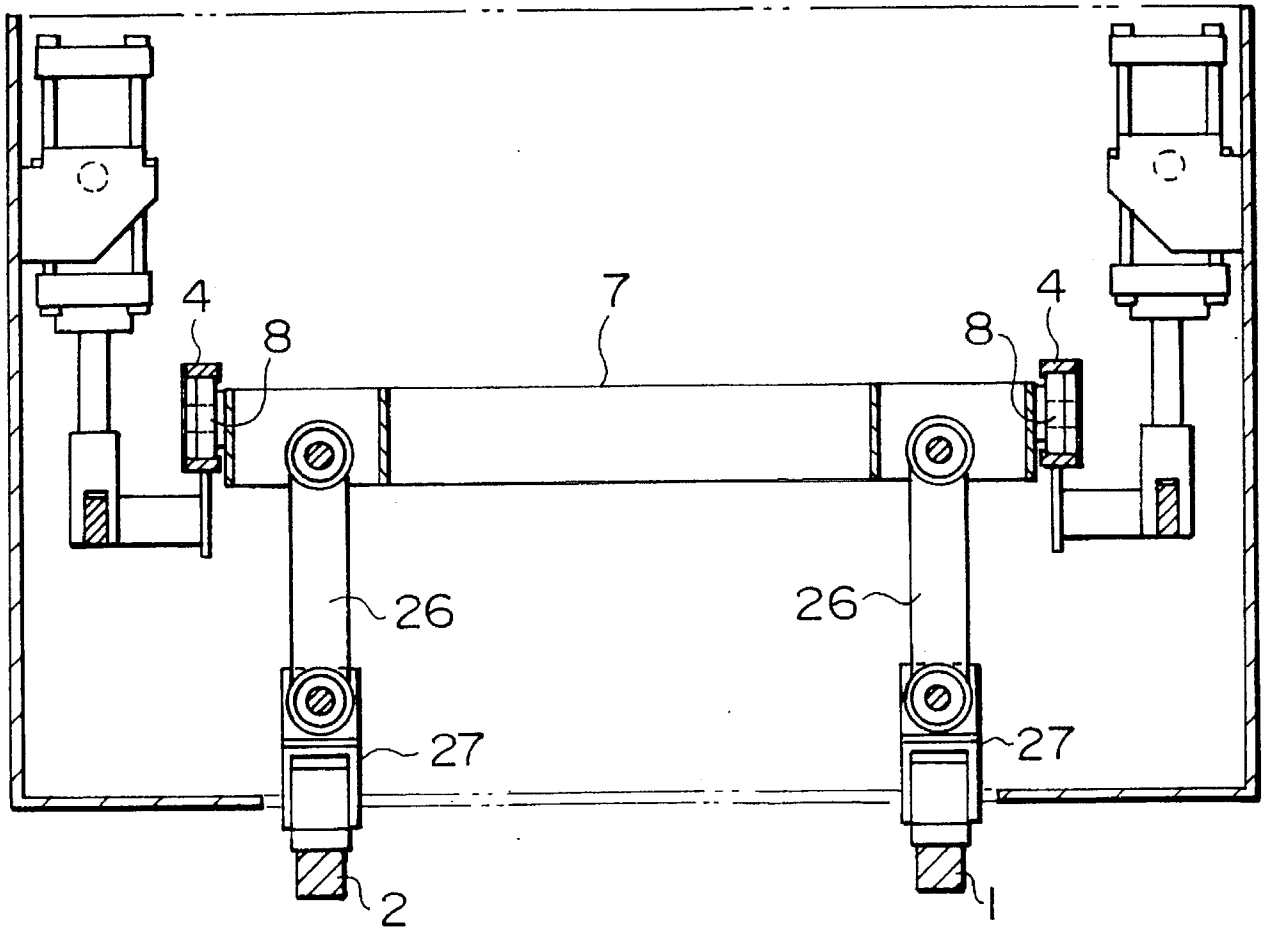
FIG. 5 is a cross section showing an advancing mechanism taken along line V—V in FIG. 3.

FIG. 3 is a top view of the advancing mechanism, FIG. 4 is its cross section taken along line IV—IV in FIG. 3, and FIG. 5 is its cross section taken along line V—V in FIG. 3. The second advancing mechanism is described based on FIGS. 3 and 4; 21 is a servo motor, a bolt 22 is connected to the spindle of the motor, and the nut 23 is engaged on the bolt 22 to form a bolt-nut screw mechanism. The servo motor 21 is rockably installed on the intermediate frame 4 via bearing 24 and the nut 23 is connected to the inner frame 3 via the bearing 25. Therefore, as shown in FIG. 4, if the servo motor 21 is rotated, the nut 23 is screw-driven in the direction of the arrow c and the inner frame 3 rocks around the center of rotation $O_6$ of the bearing 6. As a result, parallel link 10 rocks in the advance and return directions (in the direction of the arrow d).

Further, as shown in FIGS. 3 and 5, supporting links 26 are held on their respective shafts at both ends of the second inner frame 7. The lower end of said supporting links 26 are respectively connected to the front feed bar 1 and the back feed bar 2 through couplings 27. As shown in FIG. 4, supporting links 26 rock around the center of rotation $O_8$ of the bearing 8, and said parallel links 10 and said supporting links 26 also form parallel link mechanisms in the advance and return directions of both feed bars 1 and 2. Therefore, the front and back feed bars 1 and 2 can be driven by the servo motor 21 for advance and return motions. In addition, because both feed bars 1 and 2 are held at both ends by parallel links 10 and supporting links 26, the end segments will not hang down even when the central segments of feed bars 1 and 2 are removed.

Figure 6:
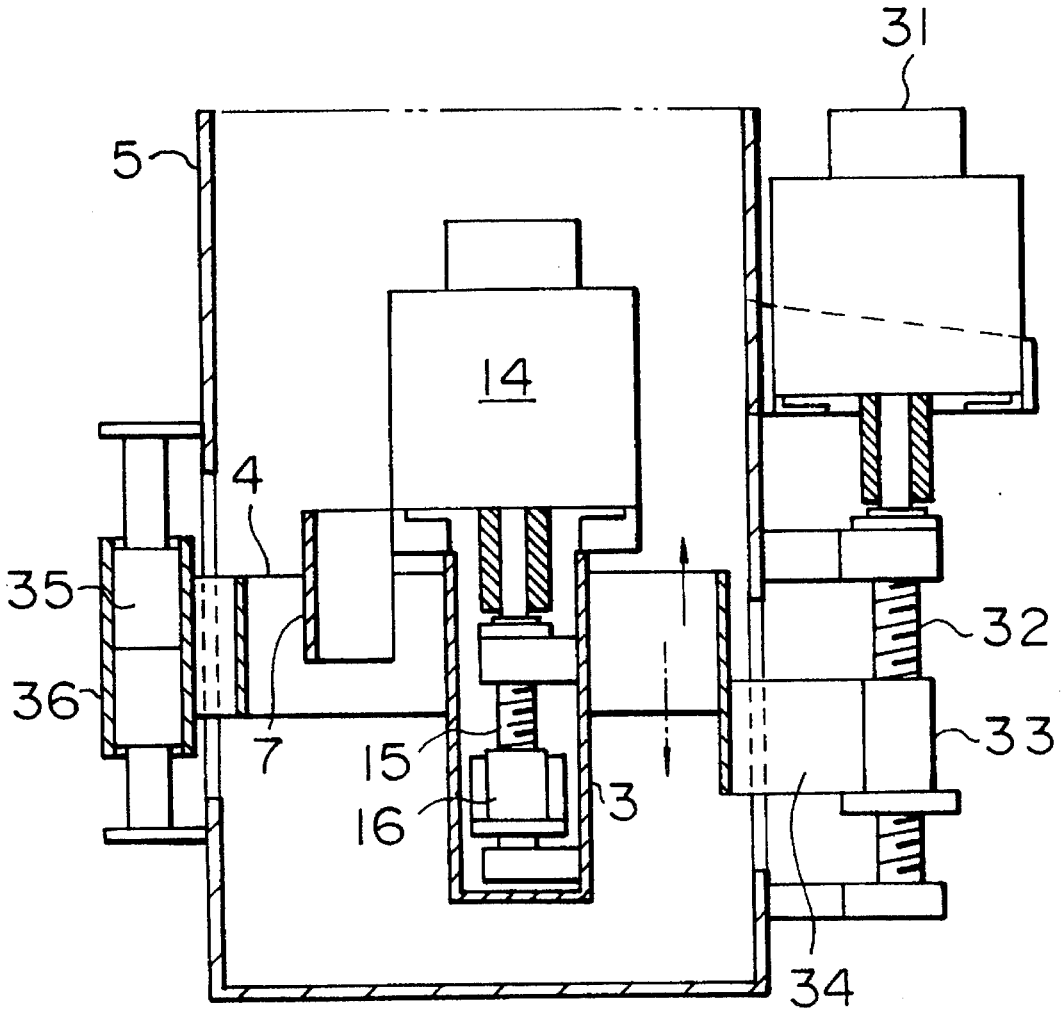
FIG. 6 is a cross section showing the principal portion of a lifting mechanism taken along line VI—VI in FIG. 3.
Figure 7:
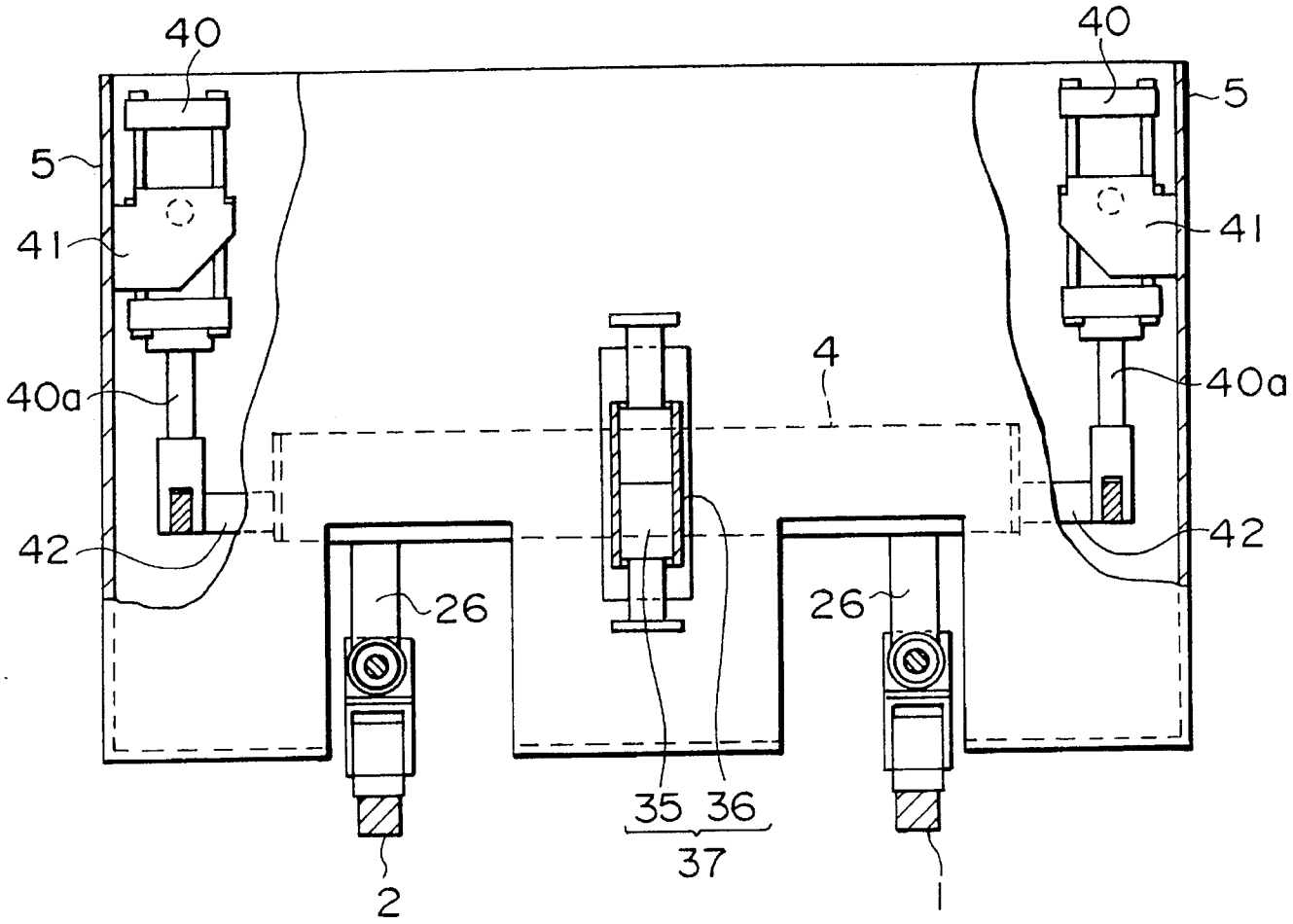
FIG. 7 is a cross section showing balance cylinders and others taken along line VII—VII in FIG. 3.
Figure 8:
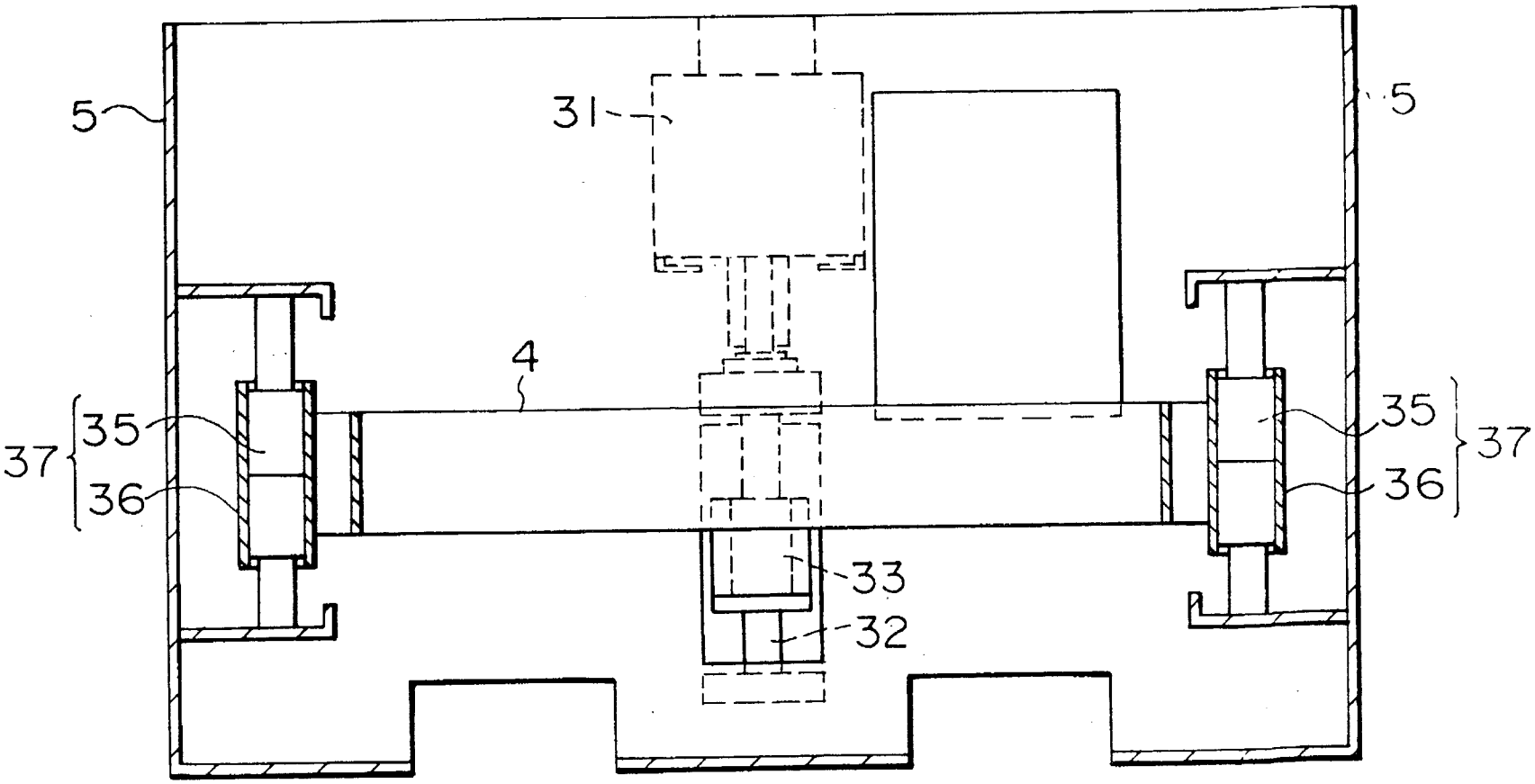
FIG. 8 is a cross section taken along line VIII—VIII in FIG. 3.
Figure 9:
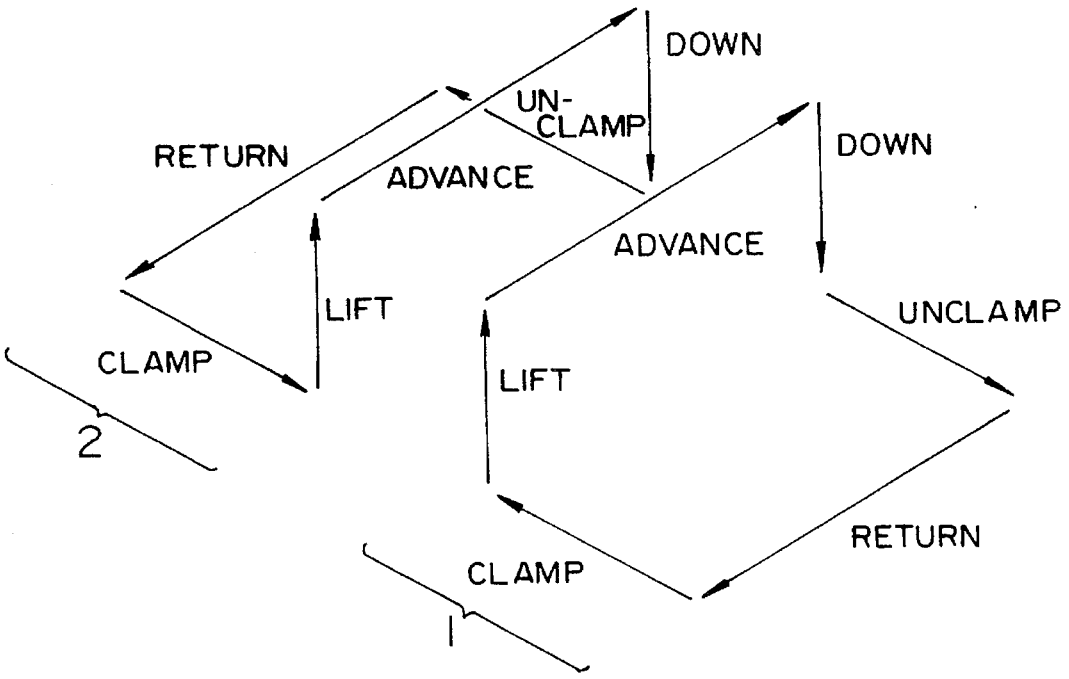
FIG. 9 is a diagram illustrating the motion of the transfer feeder.
Figure 10:
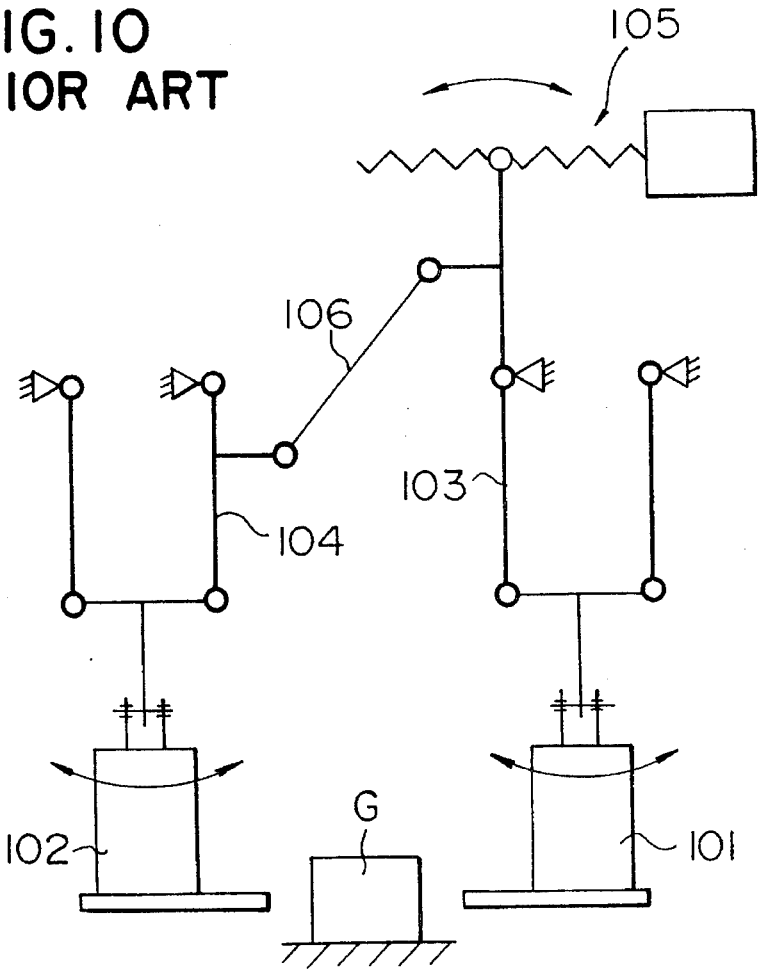
FIG. 10 PRIOR ART
FIG. 10 is a diagrammatic view of the clamping mechanism of a conventional transfer feeder.
Figure 11:
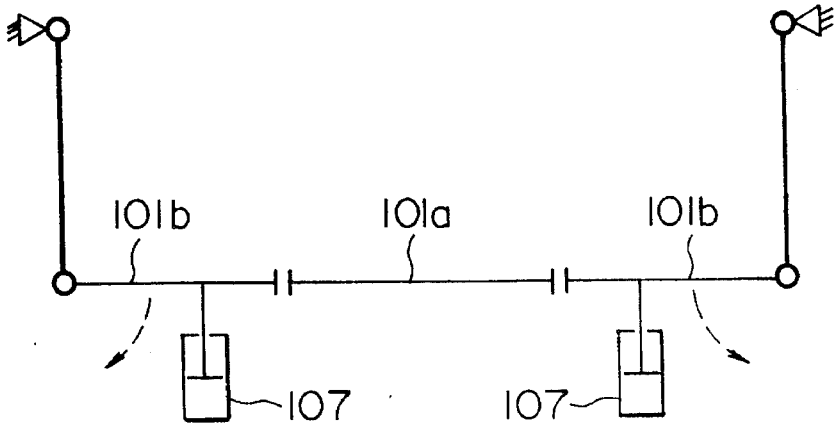
FIG. 11 PRIOR ART
FIG. 11 is a diagrammatic view of the advancing mechanism of a conventional transfer feeder.

A description of the lifting mechanism follows: FIG. 6 is a side view showing the principal portion of the lifting mechanism and is the cross section taken along line VI—VI in FIG. 3, FIG. 7 is a cross section taken along line VII—VII in FIG. 3 and showing balance cylinders 40 and others, and FIG. 8 is a cross section taken along line VIII—VIII in FIG. 3. The elevator mechanism is described below based on FIG. 6. 31 is a servo motor installed on an outer frame 5. A bolt 32 is connected to the spindle of this servo motor 31, and a nut 33 is engaged on the bolt 32. The nut 33 is connected to the intermediate frame 4 via a bracket 34. Therefore, when the servo motor 31 is rotated, the nut 33 moves up or down and the intermediate frame 4 is raised or lowered. As stated previously, the clamping mechanism and advancing mechanism are installed on this intermediate frame 4.

As shown in FIGS. 6 and 7, a guide post 35 is attached vertically on the front wall of the outer frame 5, and a guide 36 which is connected to the intermediate frame 4 is slidably inserted over this guide post. As shown in FIG. 8, guide points 35 are also attached in vertically on both inner sides of the outer frame 5, and guides 36 are also slidably inserted over these guide posts. Therefore, the intermediate frame 4 is guided in smooth rising and lowering by the guide mechanism 37.

In addition, as shown in FIG. 7, on both inner sides of the outer frame 5, balance cylinders 40 are installed on brackets 41, and their piston rods **40*a* are connected to the intermediate frame 4 by stays 42. These balance cylinders 40 consist of air cylinders and are designed to bear the weight of the advancing mechanism and clamping mechanism held by the intermediate frame 4. Therefore, lifting and lowering motions can be accomplished by the servo motor 31** using low power, and these motions can be quick.

With the invention, it is possible to provide a transfer feeder such that the clamping mechanism is perfectly synchronized and, if the central segment of a feed bar is removed, its end segments will not hang down, and the lifting mechanism can be constructed to use a low-power source.

What is claimed is:

1. In a transfer feeder of a hot-forging press for transferring workpieces in a three-dimensional space having a clamping mechanism for clamping and unclamping a workpiece by a pair of feed bars having a front feed bar and a back feed bar, an advancing mechanism to advance and return feed bars, and a lifting mechanism to raise and lower feed bars, said transfer feeder comprising:

an inner frame to rockably support said two feed bars in the clamp and unclamp directions, an intermediate frame disposed outside said inner frame and rockably supporting said inner frame in the advance and return directions, and an outer frame to contain said intermediate frame to freely raise and lower the intermediate frame;

said clamping mechanism comprising two pairs of parallel links installed between said inner frame and said two feed bars, and a first rocking mechanism to rock said pair of parallel links in the clamp and unclamp directions, said first rocking mechanism including a vertically movable member disposed between said two pairs of parallel links and a pair of connecting links, each being pivotally connected at both ends thereof to one end of said movable member and one end of said parallel links, respectively;

said advancing mechanism comprising a pair of supporting links connecting between said inner frame and said two feed bars, and a second rocking mechanism to rock said inner frame in the advance and return directions;

said supporting links together with parallel links of said clamping mechanism forming another pair of parallel links moving in the advance and return directions; and said lifting mechanism comprising of an elevator mechanism to raise and lower the intermediate frame in relation to the outer frame.

2. A transfer feeder of a hot-forging press according to claim 1, wherein said lifting mechanism further comprises balance mechanism to support the weight of said intermediate frame.

3. A transfer feeder of a hot-forging press according to claim 2, wherein said balance mechanism is composed of air cylinders or springs.

* * * * *